US008826686B2

(12) United States Patent
Takasugi

(10) Patent No.: US 8,826,686 B2
(45) Date of Patent: Sep. 9, 2014

(54) REFRIGERATION APPARATUS

(75) Inventor: Katsuji Takasugi, Ota (JP)

(73) Assignee: Panasonic Healthcare Co., Ltd., Toon-Shi (JP)

( * ) Notice: Subject to any disclaimer, the term of this patent is extended or adjusted under 35 U.S.C. 154(b) by 466 days.

(21) Appl. No.: 12/300,700

(22) PCT Filed: May 14, 2007

(86) PCT No.: PCT/JP2007/059845

§ 371 (c)(1),
(2), (4) Date: Dec. 29, 2008

(87) PCT Pub. No.: WO2007/132804

PCT Pub. Date: Nov. 22, 2007

(65) Prior Publication Data

US 2009/0113917 A1 May 7, 2009

(30) Foreign Application Priority Data

May 15, 2006 (JP) ..... 2006-135287

(51) Int. Cl.
*F25B 7/00* (2006.01)

(52) U.S. Cl.
USPC ..... 62/335

(58) Field of Classification Search
USPC ..... 62/174, 175, 228.1, 335
See application file for complete search history.

(56) References Cited

U.S. PATENT DOCUMENTS 2,133,948 A * 10/1938 Buchanan ..... 62/199
4,617,040 A * 10/1986 Yoshino ..... 62/656

(Continued)

FOREIGN PATENT DOCUMENTS

JP 62-38561 3/1987
JP 62-248968 10/1987
JP 08-127226 5/1996
JP 2000-105047 4/2000

(Continued)

OTHER PUBLICATIONS

Japanese Office Action issued in counterpart application No. 135287/2006 mailed Nov. 8, 2011 with English translation (5 pages).

*Primary Examiner* — John Frank Pettitt, III
*Assistant Examiner* — Ignacio E Landeros
(74) *Attorney, Agent, or Firm* — Kratz, Quintos & Hanson, LLP

(57) ABSTRACT

There is disclosed a refrigeration apparatus including a cascade heat exchanger and capable of reducing the depth dimension of the apparatus itself without being influenced by the thickness dimension of an insulating material for covering the cascade heat exchanger, so that the apparatus can easily be carried indoors through a usual carrying entrance. In a refrigeration apparatus 1 including a high-temperature-side refrigerant circuit 25 and a low-temperature-side refrigerant-circuit 38, an evaporator 34 of the high-temperature-side refrigerant circuit 25 and a condensing pipe 42 of the low-temperature-side refrigerant circuit 25 constitute a cascade heat exchanger 43, and an evaporation pipe 62 of the low-temperature-side refrigerant circuit 38 is configured to cool a storage chamber 4 constituted in an insulating box body 2 to an extremely low temperature. The apparatus includes a mechanical chamber 3 which is constituted by the side of an insulating box body 2 and in which a compressor 10 and the like are installed, and an insulating structure 70 in which the periphery of the cascade heat exchanger 34 is surrounded with an insulating material is arranged in a side wall of the insulating box body 2 on the side of the mechanical chamber 3.

6 Claims, 10 Drawing Sheets

(56) References Cited

U.S. PATENT DOCUMENTS

| | | | | |
|---|---|---|---|---|
| 4,788,829 | A * | 12/1988 | Takemasa et al. | 62/335 |
| 2002/0162353 | A1 * | 11/2002 | Park | 62/500 |
| 2004/0118139 | A1 * | 6/2004 | Kelly et al. | 62/199 |
| 2005/0115268 | A1 * | 6/2005 | Hallin et al. | 62/407 |

FOREIGN PATENT DOCUMENTS

| | | | |
|---|---|---|---|
| JP | 2002-333255 | | 11/2002 |
| JP | 2002333255 | A * | 11/2002 |
| JP | 2005-098581 | | 4/2005 |

* cited by examiner

REFRIGERATION APPARATUS

BACKGROUND OF THE INVENTION

The present invention relates to a refrigeration apparatus including a high-temperature-side refrigerant circuit and a low-temperature-side refrigerant circuit each constituting an independent refrigerant closed circuit in which a refrigerant discharged from a compressor is condensed and then evaporated to exert a cooling function, an evaporator of the high-temperature-side refrigerant circuit and a condenser of the low-temperature-side refrigerant circuit constituting a cascade heat exchanger, an evaporator of the low-temperature-side refrigerant circuit being configured to cool a storage chamber constituted in an insulating box body to an extremely low temperature.

Heretofore, a two-dimensional refrigeration apparatus has been used as a refrigeration apparatus having an extremely low temperature for use in storing, for example, cells, microorganisms and the like in a biological field. FIG. 10 shows a refrigerant circuit diagram of a refrigeration apparatus 135 using the two-dimensional refrigeration apparatus. A refrigerant circuit 100 is constituted of a high-temperature-side refrigerant cycle 101 and a low-temperature-side refrigerant cycle 102. A discharge-side pipe 103D of a compressor 103 constituting the high-temperature-side refrigerant cycle 101 is connected to an auxiliary condenser 105, and the auxiliary condenser 105 is connected to a frame pipe 104 (for the frame pipe, refer to a frame pipe 27 of the present application), and then connected to a condenser 107 via an oil cooler 106 of the compressor 103. The condenser 107 is cooled by a blower 116 for the condenser. Moreover, an outlet-side refrigerant pipe of the condenser 107 is connected to an evaporator 110 as an evaporator portion constituting the evaporator successively through a drier 108 and a pressure reducing unit 109. An outlet-side refrigerant pipe of the evaporator 110 is connected to an accumulator 111, and a refrigerant pipe exiting from the accumulator 111 is connected to a suction-side pipe 103S of the compressor 103.

On the other hand, a discharge-side pipe 113D of a compressor 113 constituting the low-temperature-side refrigerant cycle 102 is connected to an oil separator 114, and a refrigerant pipe connected to the outlet side of this oil separator 114 is connected to a condensing pipe 115 as a high-temperature-side pipe inserted into the evaporator 110. This condensing pipe 115 constitutes a cascade heat exchanger 130 together with the evaporator 110.

Moreover, a discharge pipe connected to the outlet side of the condensing pipe 115 is connected to a first gas-liquid separator 116 through a drier 131, and the gas-phase refrigerant separated by the gas-liquid separator 116 passes through a first intermediate heat exchanger 117 via a gas-phase pipe to flow into a second gas-liquid separator 118. A liquid-phase refrigerant separated by the gas-liquid separator 116 passes through a drier 119 and a pressure reducing unit 120 via a liquid-phase pipe, flows into the first intermediate heat exchanger 117, and evaporates the gas-phase refrigerant to cool.

The liquid-phase refrigerant separated by the second gas-liquid separator 118 passes through a drier 121 and a pressure reducing unit 122 via the liquid-phase pipe to flow into a second intermediate heat exchanger 123. The gas-phase refrigerant separated by the second gas-liquid separator 118 passes through the second intermediate heat exchanger 123 via the liquid-phase pipe, and passes through a third intermediate heat exchanger 124 and a drier 125 to flow into a pressure reducing unit 126. The pressure reducing unit 126 is connected to an evaporation pipe 127 as an evaporator arranged in a heat exchanging manner in an inner wall of an insulating box body 132 of the refrigeration apparatus on a storage chamber side, and the evaporation pipe 127 is further connected to the third intermediate heat exchanger 124.

The third intermediate heat exchanger 124 is successively connected to the second and first intermediate heat exchangers, and then connected to a suction-side pipe 113S of the compressor 113. This suction-side pipe 113S is connected to an expansion tank 128 for receiving the refrigerant during the stop of the compressor 113 through a pressure reducing unit 129.

In this refrigeration apparatus 135, the evaporation pipe 127 of the low-temperature-side refrigerant cycle 102 reaches an extremely low temperature of −150° C. or less, and even the cascade heat exchanger 130 reaches a low temperature of about −40° C. Therefore, a cascade heat exchanger 130 part needs to be sufficiently insulated. In a conventional constitution, as shown in FIG. 11, the cascade heat exchanger 130 is provided with an externally opened storage recess portion 133 beforehand secured in the back surface of the insulating box body 132 constituting the main body of the refrigeration apparatus 135, and the heat exchanger is incorporated after foaming an insulating material of the insulating box body 132 (see Japanese Patent Application Laid-Open No. 2000-105047).

Moreover, in the peripheral surface of this cascade heat exchanger 130, the insulating material is positioned, and a flat-plate-like insulating material 134 is received in a space between the storage recess portion 133 and the cascade heat exchanger 130 so as to cover the whole opening.

However, since the cascade heat exchanger 130 has a low temperature of about −40° C., dew might be attached to the outer surface of the main body around the heat exchanger. Therefore, the corresponding part needs to be sufficiently insulated, and an insulating structure is constituted so that the thickness of the insulating material 134 is remarkably increased, and the material is covered with a cover part from the outside. However, when the thickness of the insulating material 134 is increased, a protruding part corresponding to the thickness of the insulating material 134 is present in the back surface part of the main body, which causes a problem that the protruding part disturbs the installation of the refrigeration apparatus 135.

In particular, in a case where the refrigeration apparatus 135 is carried indoors, there sometimes occurs a disadvantage that the apparatus is stuck in the carrying entrance of an installation place and that it becomes difficult to carry the apparatus indoors. Therefore, to smoothly perform a carrying operation, in a case where a product is designed so that the thickness of the insulating material of this protruding part is secured over the whole main body, there is a problem that when an outer dimension is not increased, a volume in the storage chamber decreases.

To solve the problem, in a refrigerator disclosed in Japanese Patent Application Laid-Open No. 2000-105047, a constitution is employed in which the insulating material covering the back surface of the cascade heat exchanger is covered with an inner cover, a second insulating material and an outer cover covering the material are provided outside the inner cover, and the outer cover is detachably attached to the inner cover with a plurality of small screws. In consequence, during the carrying, the carrying operation of the refrigeration apparatus is performed in a state in which the outer cover is removed, which avoids a disadvantage that the protruding part is stuck in the carrying entrance as described above.

However, according to such a constitution, even in the installation place, the protruding part is still present in the back surface part of the main body. Even in such a case, owing to the product design in which the thickness of the protruding part is secured over the whole main body, there has been a problem that the storage volume decreases with respect to a depth as the outer dimension. Moreover, there has been a problem that an operation of attaching the outer cover needs to be performed after the installation, thereby resulting in a laborious carrying operation.

SUMMARY OF THE INVENTION

The present invention has been developed to solve the conventional technical problem, and an object thereof is to provide a refrigeration apparatus including a cascade heat exchanger and capable of reducing the depth dimension of the apparatus itself without being influenced by the thickness dimension of an insulating material for covering the cascade heat exchanger, so that the apparatus can easily be carried indoors through a usual carrying entrance.

A refrigeration apparatus of the present invention is characterized by comprising: a high-temperature-side refrigerant circuit and a low-temperature-side refrigerant circuit each constituting an independent refrigerant closed circuit in which a refrigerant discharged from a compressor is condensed and then evaporated to exert a cooling function, an evaporator of the high-temperature-side refrigerant circuit and a condenser of the low-temperature-side refrigerant circuit constituting a cascade heat exchanger, an evaporator of the low-temperature-side refrigerant circuit being configured to cool a storage chamber constituted in an insulating box body to an extremely low temperature, the refrigeration apparatus further comprising: a mechanical chamber which is constituted by the side of the insulating box body and in which the compressor and the like are installed; and an insulating structure in which the periphery of the cascade heat exchanger is surrounded with an insulating material and which is arranged in a side wall of the insulating box body on the side of the mechanical chamber.

A refrigeration apparatus of the invention of a second aspect is characterized by comprising: a compressor; a condenser; an evaporator; and a plurality of intermediate heat exchangers and a plurality of pressure reducing units connected in series so that a refrigerant fed back from the evaporator circulates, wherein a plurality of types of non-azeotropic mixed refrigerants are introduced, a condensed refrigerant in the refrigerants passed through the condenser is allowed to join the intermediate heat exchanger through the pressure reducing unit, a non-condensed refrigerant in the refrigerants is cooled by the intermediate heat exchanger to successively condense the refrigerant having a lower boiling point, and the refrigerant having the lowest boiling point is allowed to flow into the evaporator through the final stage of the pressure reducing unit, to cool a storage chamber constituted in the insulating box body to an extremely low temperature, the refrigeration apparatus further comprising: a mechanical chamber which is constituted by the side of the insulating box body and in which the compressor and the like are installed; and an insulating structure in which the periphery of each intermediate heat exchanger is surrounded with an insulating material and which is arranged in a side wall of the insulating box body on the side of the mechanical chamber.

A refrigeration apparatus of the invention of a third aspect is characterized by comprising: a high-temperature-side refrigerant circuit and a low-temperature-side refrigerant circuit each constituting an independent refrigerant closed circuit in which a refrigerant discharged from a compressor is condensed and then evaporated to exert a cooling function, the low-temperature-side refrigerant circuit having the compressor, a condenser, an evaporator, and a plurality of intermediate heat exchangers and a plurality of pressure reducing units connected in series so that the refrigerant fed back from the evaporator circulates, wherein a plurality of types of non-azeotropic mixed refrigerants are introduced, a condensed refrigerant in the refrigerants passed through the condenser is allowed to join the intermediate heat exchanger through the pressure reducing unit, a non-condensed refrigerant in the refrigerants is cooled by the intermediate heat exchanger to successively condense the refrigerant having a lower boiling point, the refrigerant having the lowest boiling point is allowed to flow into the evaporator through the final stage of the pressure reducing unit, an evaporator of the high-temperature-side refrigerant circuit and the condenser of the low-temperature-side refrigerant circuit constitute a cascade heat exchanger, and the evaporator of the low-temperature-side refrigerant circuit is configured to cool a storage chamber constituted in the insulating box body to an extremely low temperature, the refrigeration apparatus further comprising: a mechanical chamber which is constituted by the side of the insulating box body and in which the compressor and the like are installed; and an insulating structure in which the peripheries of the cascade heat exchanger and each intermediate heat exchanger are surrounded with an insulating material and which is arranged in a side wall of the insulating box body on the side of the mechanical chamber.

A refrigeration apparatus of the invention of a fourth aspect is characterized in that in the above inventions, the insulating box body is formed of a composite constitution of vacuum insulating panels and a foam insulating material, and the vacuum insulating panels are arranged in front and rear walls of the insulating box body and a side wall of the insulating box body on a side opposite to the mechanical chamber.

A refrigeration apparatus of the invention of a fifth aspect is characterized in that in the above inventions, the insulating structure is detachably inserted from the backside, the front side or the upside.

A refrigeration apparatus of the invention of a sixth aspect is characterized in that in the above invention, a pipe from the insulating structure is opposed to the surface in a direction in which the insulating structure is inserted or removed.

According to the present invention, the refrigeration apparatus comprises the high-temperature-side refrigerant circuit and the low-temperature-side refrigerant circuit each constituting the independent refrigerant closed circuit in which the refrigerant discharged from the compressor is condensed and then evaporated to exert the cooling function. The evaporator of the high-temperature-side refrigerant circuit and the condenser of the low-temperature-side refrigerant circuit constitute the cascade heat exchanger, and the evaporator of the low-temperature-side refrigerant circuit is configured to cool the storage chamber constituted in the insulating box body to the extremely low temperature. The refrigeration apparatus further comprises the mechanical chamber which is constituted by the side of the insulating box body and in which the compressor and the like are installed, and the insulating structure in which the periphery of the cascade heat exchanger is surrounded with the insulating material and which is arranged in the side wall of the insulating box body on the side of the mechanical chamber. Therefore, as compared with a case where the cascade heat exchanger is installed on the back surface portion of the insulating box body, the depth dimension of the whole apparatus can be reduced.

In consequence, it is possible to avoid a disadvantage that owing to the presence of a protruding part of the insulating structure for surrounding the cascade heat exchanger, the apparatus is stuck in a usual carrying entrance. Therefore, the refrigeration apparatus can easily be carried inwards or outwards without especially reducing a storage volume. Moreover, even in an installation place, the insulating structure for surrounding the cascade heat exchanger does not protrude externally from the back surface of the apparatus, so that an area required for installation can be decreased.

According to the invention of the second aspect, the refrigeration apparatus comprises the compressor, the condenser, the evaporator, and the plurality of intermediate heat exchangers and the plurality of pressure reducing units connected in series so that the refrigerant fed back from the evaporator circulates. The plurality of types of non-azeotropic mixed refrigerants are introduced, the condensed refrigerant in the refrigerants passed through the condenser is allowed to join the intermediate heat exchanger through the pressure reducing unit, the non-condensed refrigerant in the refrigerants is cooled by the intermediate heat exchanger to successively condense the refrigerant having the lower boiling point, and the refrigerant having the lowest boiling point is allowed to flow into the evaporator through the final stage of the pressure reducing unit, to cool the storage chamber constituted in the insulating box body to the extremely low temperature. The refrigeration apparatus further comprises the mechanical chamber which is constituted by the side of the insulating box body and in which the compressor and the like are installed, and the insulating structure in which the periphery of each intermediate heat exchanger is surrounded with the insulating material and which is arranged in the side wall of the insulating box body on the side of the mechanical chamber. Therefore, as compared with a case where the insulating structure in which the periphery of each intermediate heat exchanger is surrounded with the insulating material is installed on the back surface portion of the insulating box body as in the conventional example, the depth dimension of the whole apparatus can be reduced.

In consequence, it is possible to avoid the disadvantage that owing to the presence of the protruding part of the insulating structure for surrounding the periphery of each intermediate heat exchanger, the apparatus is stuck in the usual carrying entrance. Therefore, the refrigeration apparatus can easily be carried inwards or outwards without especially reducing the storage volume. Moreover, even in the installation place, the insulating structure for surrounding the periphery of each intermediate heat exchanger does not protrude externally from the back surface of the apparatus, so that the area required for installation can be decreased.

According to the invention of the third aspect, the refrigeration apparatus comprises the high-temperature-side refrigerant circuit and the low-temperature-side refrigerant circuit each constituting the independent refrigerant closed circuit in which the refrigerant discharged from the compressor is condensed and then evaporated to exert the cooling function. The low-temperature-side refrigerant circuit has the compressor, the condenser, the evaporator, and the plurality of intermediate heat exchangers and the plurality of pressure reducing units connected in series so that the refrigerant fed back from the evaporator circulates. The plurality of types of non-azeotropic mixed refrigerants are introduced, the condensed refrigerant in the refrigerants passed through the condenser is allowed to join the intermediate heat exchanger through the pressure reducing unit, the non-condensed refrigerant in the refrigerants is cooled by the intermediate heat exchanger to successively condense the refrigerant having the lower boiling point, the refrigerant having the lowest boiling point is allowed to flow into the evaporator through the final stage of the pressure reducing unit, the evaporator of the high-temperature-side refrigerant circuit and the condenser of the low-temperature-side refrigerant circuit constitute the cascade heat exchanger, and the evaporator of the low-temperature-side refrigerant circuit is configured to cool the storage chamber constituted in the insulating box body to the extremely low temperature. The refrigeration apparatus further comprises the mechanical chamber which is constituted by the side of the insulating box body and in which the compressor and the like are installed, and the insulating structure in which the peripheries of the cascade heat exchanger and each intermediate heat exchanger are surrounded with the insulating material and which is arranged in the side wall of the insulating box body on the side of the mechanical chamber. Therefore, as compared with a case where the insulating structure in which the peripheries of the cascade heat exchanger and each intermediate heat exchanger are surrounded with the insulating material is installed on the back surface portion of the insulating box body as in the conventional example, the depth dimension of the whole apparatus can be reduced.

In consequence, it is possible to avoid the disadvantage that owing to the presence of the protruding part of the insulating structure for surrounding the peripheries of the cascade heat exchanger and each intermediate heat exchanger, the apparatus is stuck in the usual carrying entrance. Therefore, the refrigeration apparatus can easily be carried inwards or outwards without especially reducing the storage volume. Moreover, even in the installation place, the insulating structure for surrounding the peripheries of the cascade heat exchanger and each intermediate heat exchanger does not protrude externally from the back surface of the apparatus, so that the area required for installation can be decreased.

According to the invention of the fourth aspect, in the above inventions, the insulating box body is formed of the composite constitution of the vacuum insulating panels and the foam insulating material, and the vacuum insulating panels are arranged in the front and rear walls of the insulating box body and the side wall of the insulating box body on the side opposite to the mechanical chamber. In consequence, unlike the conventional example, the back surface of the insulating box body is not provided with the insulating structure for surrounding the peripheries of the cascade heat exchanger and each intermediate heat exchanger. Therefore, the vacuum insulating panels can be arranged in the front and rear walls of the insulating box body and the side wall of the insulating box body on the side opposite to the mechanical chamber without being influenced by the insulating structure. Consequently, the leakage of cold from the storage chamber can be decreased, and the wasting of useless cooling energy can be suppressed.

In particular, the vacuum insulating panels are arranged in the front and rear walls of the insulating box body constituted so as to face the outside and the side wall of the insulating box body on the side opposite to the mechanical chamber. Therefore, even when the storage chamber is cooled to an extremely low temperature of, for example, −80° C. or less, the insulating performance of the insulating box body itself can be improved, and dimensions can be reduced. Even when an outer dimension is similar to that of the conventional example, a storage volume in the storage chamber can be enlarged. Alternatively, even when the storage volume is similar to that of the conventional example, the outer dimension can be reduced. In consequence, an area required for installing the refrigeration apparatus can be decreased.

According to the invention of the fifth aspect, in the above inventions, the insulating structure is detachably inserted from the backside, the front side or the upside. In consequence, the insulating structure in which the cascade heat exchanger and the intermediate heat exchangers are integrated with the insulating material is inserted from the backside, the front side or the upside, the cascade heat exchanger and the intermediate heat exchangers can easily be assembled in the main body, and assembling operability can be improved. Moreover, when the integrated insulating structure is extracted to the backside, the front side or the upside, the insulating structure can be removed from the main body, and a maintenance operation of the cascade heat exchanger and the intermediate heat exchangers can easily be performed.

Moreover, according to the invention of the sixth aspect, in the above invention, the pipe from the insulating structure is opposed to the surface in the direction in which the insulating structure is inserted or removed. In consequence, after installing the compressor and the like in the mechanical chamber, the insulating structure is finally inserted. In this state, pipes from the mechanical chamber side or the insulating box body side can easily be connected, and piping operability and assembling operability can be improved.

DETAILED DESCRIPTION OF THE PREFERRED EMBODIMENT

Figure 1:
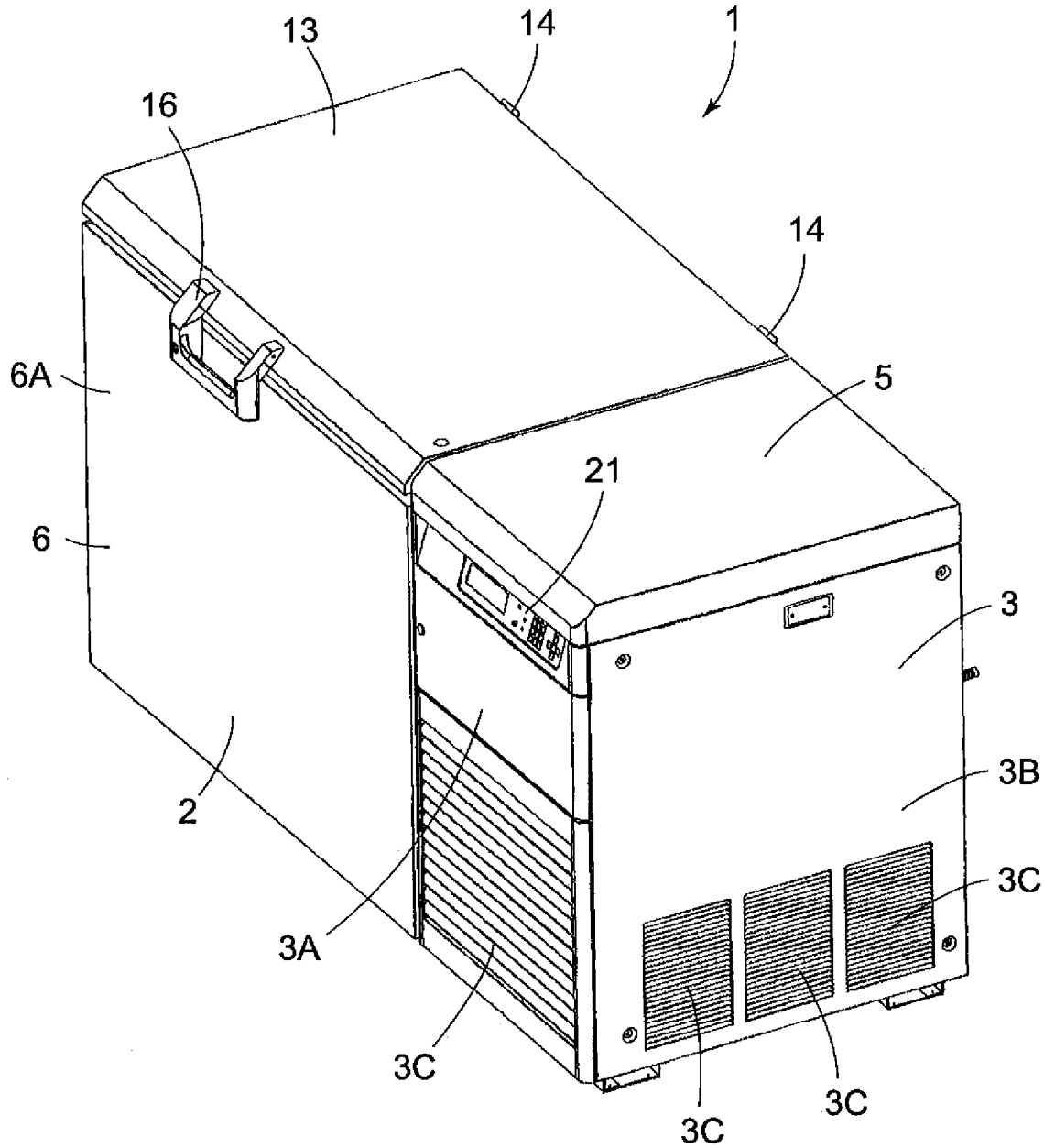
FIG. 1 is a perspective view of a refrigeration apparatus to which the present invention is applied.
Figure 2:
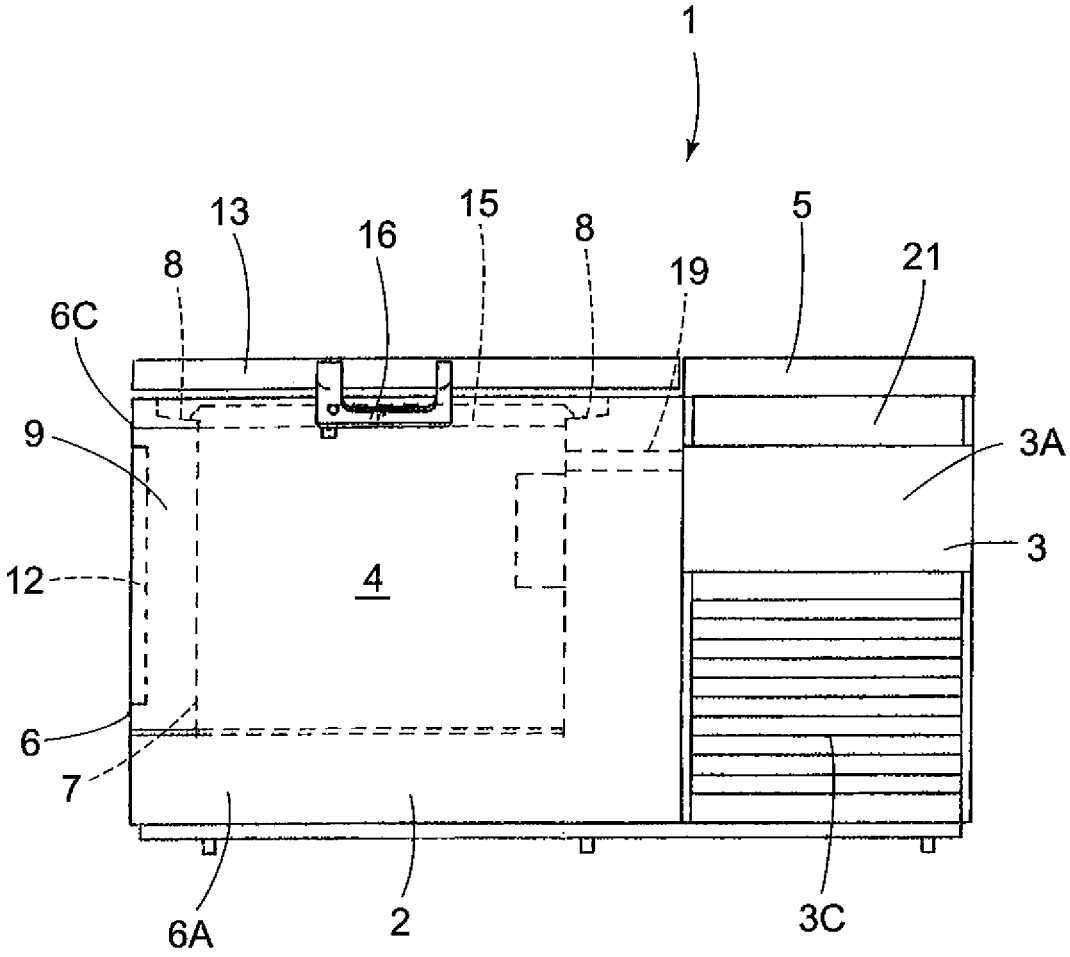
FIG. 2 is a front view of the refrigeration apparatus of FIG. 1.
Figure 3:
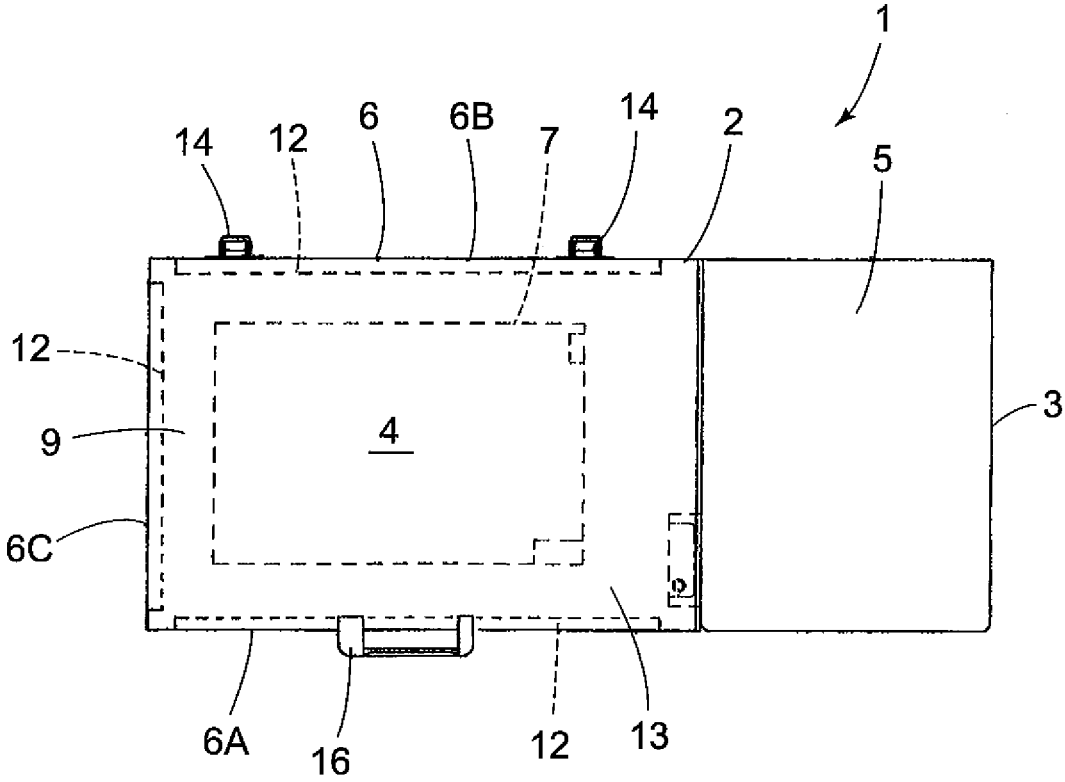
FIG. 3 is a plan view of the refrigeration apparatus of FIG. 1.
Figure 4:
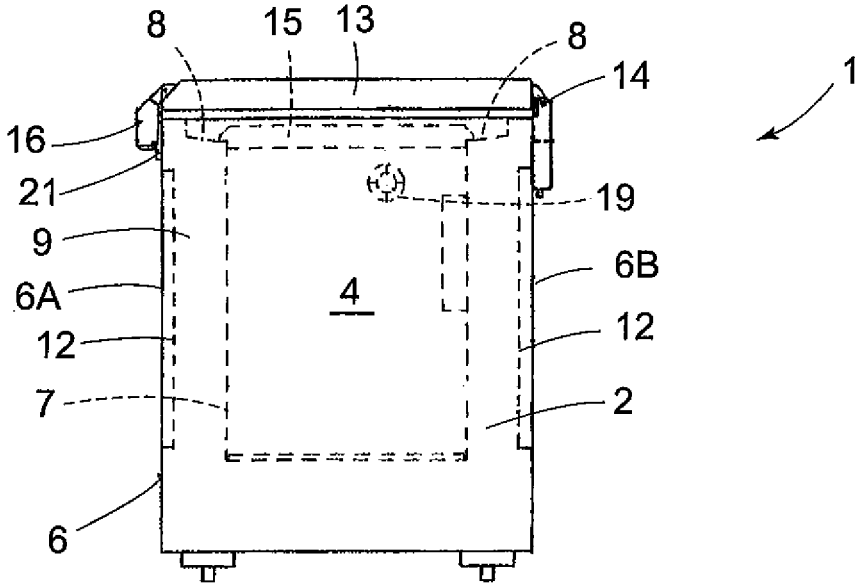
FIG. 4 is a side view in a state in which a storage chamber is seen through the refrigeration apparatus of FIG. 1.
Figure 5:
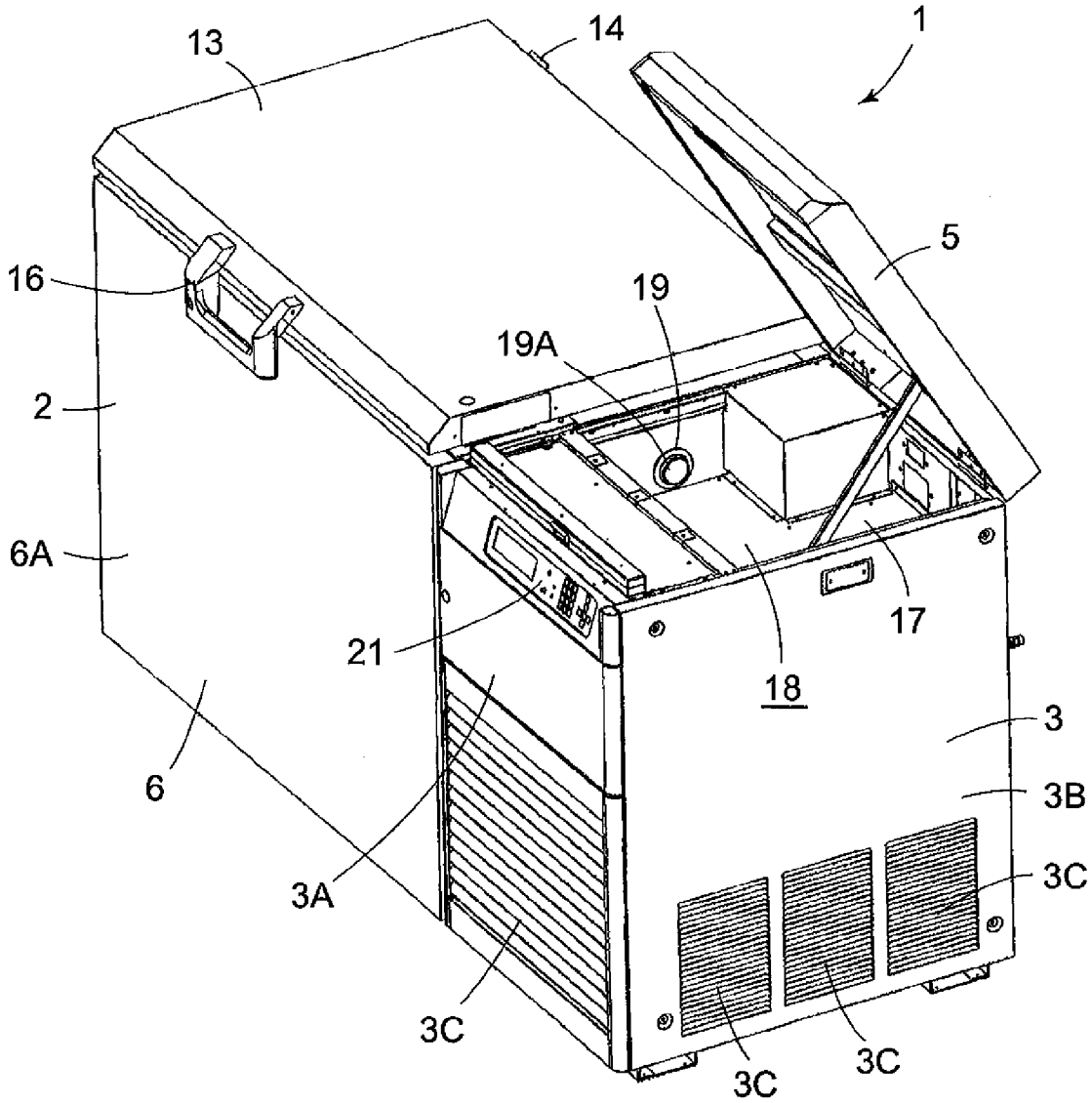
FIG. 5 is a perspective view of the refrigeration apparatus in a state in which a top panel is opened.

An embodiment of the present invention will hereinafter be described with reference to the drawings. FIG. 1 is a perspective view of a refrigeration apparatus 1 to which the present invention is applied, FIG. 2 is a front view of the refrigeration apparatus 1, FIG. 3 is a plan view of the refrigeration apparatus 1, FIG. 4 is a side view in a state in which a storage chamber 4 is seen through the refrigeration apparatus 1, and FIG. 5 is a perspective view of the refrigeration apparatus 1 in a state in which a top panel 5 is opened. The refrigeration apparatus 1 of the present embodiment is suitable for storing, at an extremely low temperature, for example, a living tissue, a specimen or the like to be stored at a low temperature for a long time, and a main body of the apparatus is constituted of an insulating box body 2 which opens in an upper surface, and a mechanical chamber 3 which is positioned by the side of the insulating box body 2 and in which a compressor 10 and the like are installed.

This insulating box body 2 is constituted of an outer box 6 made of a steel plate and an inner box 7 made of a satisfactorily thermally conductive metal such as aluminum, the boxes having opened upper surfaces. The insulating box body is also constituted of a breaker 8 connecting the upper ends of both the boxes 6, 7 to each other, and an insulating material 9 with which a space surrounded by the outer box 6, the inner box 7 and the breaker 8 is filled by an on-site foam system and which is made of a polyurethane resin. The inside of the inner box 7 is the storage chamber 4 having an open upper surface.

In the present embodiment, a targeted temperature (hereinafter referred to as the in-chamber temperature) in the storage chamber 4 is set to, for example, −150° C. or less. Therefore, the insulating box body 2 which separates the inside of the storage chamber 4 and outside air needs to have large insulating capability against a set low in-chamber temperature around 0° C. Therefore, to secure the insulating capability only by the insulating material 9 made of the polyurethane resin, the material has to be formed to be remarkably thick. There is also a problem that a sufficient storage amount in the storage chamber 4 cannot be secured with a limited main body dimension.

To solve the problem, in the insulating box body 2 of the present embodiment, vacuum insulating panels 12 made of glass wool are arranged in the inner wall surfaces of a front wall 6A of the outer box 6, a rear wall 6B and a side wall 6C positioned on a side opposite to a side provided with the mechanical chamber 3. The panels are tentatively fixed with an adhesive double coated tape, and then a space between both the boxes 6 and 7 is filled with the insulating material 9 by the on-site foam system.

To constitute this vacuum insulating panel 12, glass wool having insulating properties is received in a container constituted of a multilayered film made of aluminum, a synthetic resin or the like which does not have any gas permeability. Afterward, air is discharged from the container by predetermined vacuum exhaust means, and an opening of the container is thermally sealed and joined. In consequence, since the vacuum insulating panel 12 has the insulating performance, the thickness dimension of the insulating material 9 is decreased as compared with a conventional example, but the same insulating effect can be obtained.

On the other hand, an evaporator (an evaporation pipe) 62 constituting a refrigerant circuit of a cooling apparatus R described later in detail is attached to the peripheral surface of the inner box 7 on the insulating material 9 side in a heat exchange manner.

Moreover, as shown in FIGS. 2 and 4, the upper surface of the breaker 8 of the insulating box body 2 having the above constitution is formed in a staircase-like shape, and an insulating door 13 is provided on the surface via a packing (not shown) so that the insulating door is rotatable around one end, that is, the rear end of the door in the present embodiment by pivotable members 14, 14. Moreover, the upper-surface opening of the storage chamber 4 is provided with an openable/closable inner lid 15 constituted of an insulating material. Moreover, the lower surface of the insulating door 13 is provided with a pressing portion configured to protrude downwards. In consequence, the pressing portion of the insulating door 13 presses the inner lid 15 to openably close the upper-surface opening of the storage chamber 4. Moreover, the other end, that is, the front end of the insulating door 13 in the present embodiment is provided with a handle portion 16, and the handle portion 16 is operated to open or close the insulating door 13.

On the other hand, by the aide of the insulating box body 2, a front panel 3A, a rear panel (not shown) and a side panel 3B constituting a side surface on a side opposite to a side provided with the insulating box body 2 form the mechanical chamber 3. The mechanical chamber 3 of the present embodiment is provided with a partition plate 17 which divides the inside of the chamber into upper and lower chambers. The compressor 10, a compressor 20 and the like constituting the cooling apparatus R as described above are received and installed under the partition plate 17, and the front panel 3A and the side panel 3B positioned under the partition plate 17 are provided with slits 3C for ventilation.

An upper mechanical chamber 18 having an opened upper surface is constituted above the partition plate 17. The upper-surface opening of the upper mechanical chamber 18 is provided with the top panel 5 so that the panel is rotatable around one end, that is, the rear end of the panel in the present embodiment, whereby the upper mechanical chamber 18 is openably closed. It is to be noted that a panel positioned on the front surface of the upper mechanical chamber 18 is an operation panel 21 for operating the refrigeration apparatus 1.

A side surface constituting this upper mechanical chamber 18 on the insulating box body 2 side is provided with a measurement hole 19. This measurement hole 19 is extended through the outer box 6, the insulating material 9 and the inner box 7 constituting the insulating box body 2 so as to communicate with the storage chamber 4 formed in the insulating box body 2 provided adjacent to the measurement hole. Through the measurement hole 19, a temperature sensor can be inserted into the storage chamber 4 from the outside, and a wiring line drawn from the temperature sensor is connected to an external recording apparatus main body through the measurement hole 19. Moreover, a gap between this measurement hole 19 and the wiring line is closed by a plug 19A constituted of a sponge-like deformable special material having insulating properties. It is to be noted that the measurement hole 19 is closed by the plug 19A in an insulating manner in a state in which the temperature sensor is not attached to the hole.

In consequence, when an instrument for measuring or recording the temperature in the storage chamber 4 is used, the top panel 5 provided in the mechanical chamber 3 is opened, and the measuring instrument can be inserted into the storage chamber 4 through the measurement hole 19 formed in the side surface of the insulating box body 2 positioned in the upper mechanical chamber 18. This can facilitate an operation of installing the measuring instrument in the storage chamber 4 cooled to a predetermined extremely low temperature.

In particular, unlike a measurement hole provided in a conventional refrigeration apparatus, the measurement hole 19 of the present embodiment is formed in the side surface of the insulating box body 2 on the mechanical chamber 18 side. Therefore, even when the refrigeration apparatus 1 is installed adjacent to the wall of an installation environment such as the laboratory, or another device, a space necessary for using the measurement hole 19 does not especially have to be disposed. In consequence, an area required for installing the refrigeration apparatus 1 can be decreased, which is suitable for determining the layout of the laboratory or the like.

Moreover, since the measurement hole 19 is formed in the wall surface of the insulating box body 2 on a side adjacent to the mechanical chamber 3, the vacuum insulating panels 12 can be provided in the side surface other than the side surface adjacent to the mechanical chamber 3, that is, the front and rear walls and the side surface of the insulating box body 2 constituted so as to face the outside without influencing the forming position of the measurement hole 19.

Furthermore, the wail surface of the insulating box body 2 provided with the measurement hole 19 is provided with an insulating structure 70 in which a cascade heat exchanger 43, an intermediate heat exchanger 48 and the like are integrally formed of the insulating material as described later in detail. Therefore, even when the vacuum insulating panel 12 is not provided, the inside of the storage chamber 4 can effectively be insulated by the insulating structure 70.

In consequence, the leakage of cold from the storage chamber 4 can be decreased, and the wasting of useless cooling energy can be suppressed.

Therefore, even when the inside of the storage chamber 4 has an extremely low temperature of, for example, −150° C. or less as in the present embodiment, the insulating performance of the insulating box body 2 itself can be improved, and the dimension of an insulating wall can be decreased. Even when the refrigeration apparatus has an outer dimension similar to that in a conventional example, a storage volume in the storage chamber 4 can be increased. Alternatively, even when the refrigeration apparatus has the storage volume similar to that in the conventional example, the outer dimension can be decreased. Even in this case, the area required for installing the refrigeration apparatus 1 can be decreased.

Furthermore, the measurement hole 19 of the present embodiment can be covered with the top panel 5 which can openably close the upper-surface opening of the upper mechanical chamber 18, whereby the appearance of the apparatus has a constitution in which the measurement hole 19 is not exposed, and the appearance can be improved. Moreover, when the top panel 5 is opened, an operation can easily be performed with respect to the measurement hole 19, and operability can be improved. When the partition plate 17 is removed, another device constituting the cooling apparatus R installed under the partition plate 17 can easily be operated, and the efficiency of a maintenance operation can be improved. The mechanical chamber 18 is closed with the top panel 5 in a case other than the case where the operation is performed with respect to the measurement hole 19, so that the top panel 5 can be used as a side table for an operation, and the panel is convenient for an operation of storing articles such as samples in the storage chamber 4 or taking the articles from the chamber.

It is to be noted that in the present embodiment, the measurement hole 19 is covered with the top panel 5 which closes the upper-surface opening of the upper mechanical chamber 18, but this is not restrictive, and a lid member for covering the measurement hole 19 or the like may be provided in the vicinity of the measurement hole 19.

Figure 6:
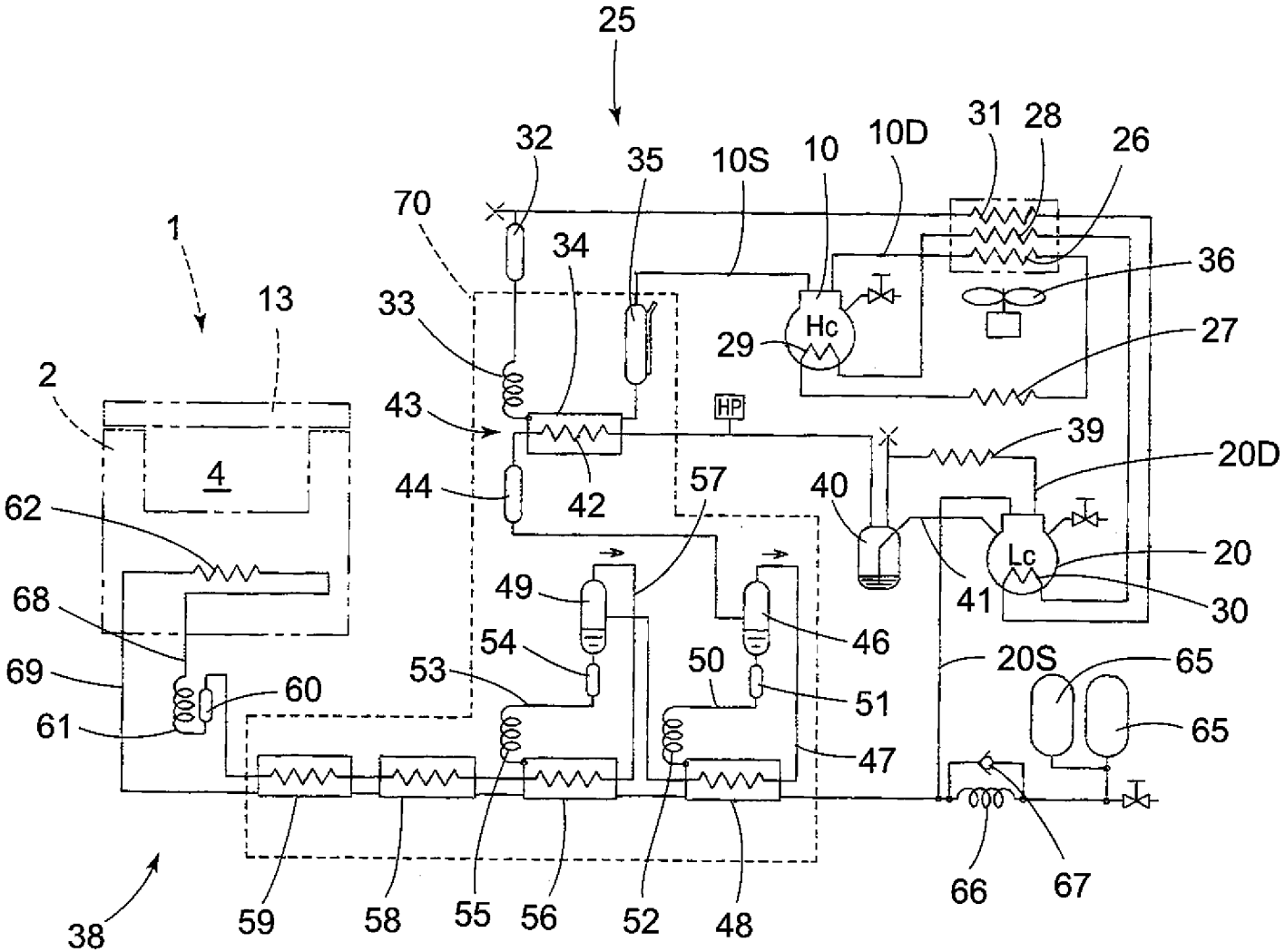
FIG. 6 is a refrigerant circuit diagram of the refrigeration apparatus of FIG. 1.

Next, the refrigerant circuit of the refrigeration apparatus 1 of the present embodiment will be described with reference to FIG. 6. The refrigerant circuit of the refrigeration apparatus 1 in the present embodiment is constituted of a two-dimensional two-stage refrigerant circuit, as a multi-dimensional multistage refrigerant circuit, including independent refrigerant circuits of a high-temperature-side refrigerant circuit 25 as a first refrigerant circuit and a low-temperature-side refrigerant circuit 38 as a second refrigerant circuit.

The compressor 10 constituting the high-temperature-side refrigerant circuit 25 is an electromotive compressor using a one-phase or three-phase alternating-current power source, and a discharge side pipe 10D of the compressor 10 is connected to an auxiliary condenser 26. To heat an storage chamber 4 opening edge and prevent dew condensation, this auxiliary condenser 26 is connected to a refrigerant pipe 27

(hereinafter referred to as a frame pipe) arranged on the back side of this opening edge. Moreover, this frame pipe 27 is connected to an oil cooler 29 of the compressor 10, and then connected to a condenser 28. Furthermore, the refrigerant pipe exiting from the condenser 28 is connected to an oil cooler 30 of the compressor 20 constituting the low-temperature-side refrigerant circuit 38, and is then connected to a condenser 31. The refrigerant pipe exiting from the condenser 31 is connected to an evaporator 34 as an evaporator portion constituting the evaporator successively via a drier 32 and a capillary tube 33 as a pressure reducing unit. An outlet side refrigerant pipe of the evaporator 34 is connected to an accumulator 35 as a refrigerant liquid reservoir, and the refrigerant pipe exiting from the accumulator 35 is connected to a suction side pipe 10S of the compressor 10. It is to be noted that the auxiliary condenser 26 and the condensers 28 and 31 in the present embodiment are constituted as an integral condenser, and are cooled by a blower 36 for the condenser.

The high-temperature-side refrigerant circuit 25 is filled with a refrigerant constituted of R407D and n-pentane as non-azeotropic refrigerants having different boiling points. R407D is constituted of R32 (difluoromethane: $CH_2F_2$), R125 (pentafluoroethane: $CHF_2CF_3$), and R134a (1,1,1,2-tetrafluoroethane: $CH_2FCF_3$), and a composition includes 15 wt % of R32, 15 wt % of R125 and 70 wt % of R134a. As to the boiling points of the refrigerants, R32 has −51.8° C., R125 has −48.57° C. and R134a has −26.16° C. Moreover, the boiling point of n-pentane is +36.1° C.

The high-temperature gas refrigerant discharged from the compressor 10 is condensed, releases heat and is liquefied by the auxiliary condenser 26, the frame pipe 27, the oil cooler 29, the condenser 28, the oil cooler 30 of the compressor 20 of the low-temperature-side refrigerant circuit 38 and the condenser 31. Afterward, a water content contained in the refrigerant is removed by the drier 32, and the pressure of the refrigerant is reduced by the capillary tube 33. The refrigerants successively flow into the evaporator 34 to evaporate the refrigerants R32, R125 and R134a. Then, vaporization heat is absorbed from a surrounding area to cool the evaporator 34, and the refrigerant returns to the compressor 10 through the accumulator 35 as the refrigerant liquid reservoir.

At this time, the compressor 10 has a capability of, for example, 1.5 HP, and the final reaching temperature of the evaporator 34 which is being operated is in a range of −27° C. to −35° C. At such a low temperature, since n-pentane of the refrigerant has a boiling point of +36.1° C., the refrigerant does not evaporate in the evaporator 34 and still has a liquid state. Therefore, the refrigerant hardly contributes to cooling, but the refrigerant has a function of feeding the lubricant of the compressor 10 and a mixed water content which cannot completely be absorbed by the drier 32 back to the compressor 10 in a state in which the same is dissolved in the refrigerant. The refrigerant also has a function of lowering the temperature of the compressor 10 by the evaporation of the liquid refrigerant in the compressor 10.

On the other hand, the compressor 20 of the low-temperature-side refrigerant circuit 38 is an electromotive compressor using a one-phase or three-phase alternating-current power source in the same manner as in the compressor 10, and a discharge side pipe 20D of the compressor 20 is connected to an oil separator 40 via a radiator 39 constituted of a wire condenser. This oil separator 40 is connected to an oil return tube 41 which returns to the compressor 20. A refrigerant pipe connected to the outlet side of the oil separator 40 is connected to a condensing pipe 42 as a high-pressure-side pipe inserted into the evaporator 34. This condensing pipe 42 constitutes a cascade heat exchanger 43 together with the evaporator 34.

Moreover, a discharge pipe connected to the outlet side of the condensing pipe 42 is connected to a first gas-liquid separator 46 via a drier 44. A gas-phase refrigerant separated by the gas-liquid separator 46 passes through the first intermediate heat exchanger 48 via a gas-phase pipe 47 to flow into a second gas-liquid separator 49. A liquid-phase refrigerant separated by the first gas-liquid separator 46 flows into the first intermediate heat exchanger 48 through a liquid-phase pipe 50, a drier 51 and a capillary tube 52 as a pressure reducing unit.

The liquid-phase refrigerant separated by the second gas-liquid separator 49 flows into a second intermediate heat exchanger 56 through a liquid-phase pipe 53, a drier 54 and a capillary tube 55 as a pressure reducing unit. The gas-phase refrigerant separated by the second gas-liquid separator 54 is cooled and liquefied while passing through a gas-phase pipe 57, the second intermediate heat exchanger 56 and third and fourth intermediate heat exchangers 58, 59, and the refrigerant flows into a capillary tube 61 as a pressure reducing unit through a pipe 68 and a drier 60. The capillary tube 61 is connected to an evaporation pipe 62 as an evaporator, and the evaporation pipe 62 is connected to the fourth intermediate heat exchanger 59 via a return pipe 69.

The fourth intermediate heat exchanger 59 is successively connected to the third, second and first intermediate heat exchangers 58, 56 and 48, and then connected to a suction side pipe 20S of the compressor 20. The suction side pipe 20S is further connected to expansion tanks 65 which store the refrigerant during the stop of the compressor 20 via a capillary tube 66 as a pressure reducing unit. The capillary tube 66 is connected in parallel with a check valve 67 in an expansion tank 65 direction as a forward direction.

In the low-temperature-side refrigerant circuit 38, a non-azeotropic mixed refrigerant including R245fa, R600, R404A, R508, R14, R50 and R740 is introduced as a mixed refrigerant of seven types of refrigerants having different boiling points. R245fa is 1,1,1,-3,3-pentafluoropropane ($CF_3CH_2CHF_2$), and R600 is butane ($CH_3CH_2CH_2CH_3$). R245fa has a boiling point of +15.3° C., and R600 has a boiling point of −0.5° C. Therefore, when these refrigerants are mixed at a predetermined ratio, the mixed refrigerant can be used as a substitute for heretofore used R21 having a boiling point of +8.9° C.

It is to be noted that R600 is a combustible substance. When R600 is mixed with incombustible R245fa at a predetermined ratio, that is, R245fa/R600:70/30 in the present embodiment, the refrigerant is introduced as an incombustible refrigerant in the refrigerant circuit 38. It is to be noted that in the present embodiment, R245fa is set to 70 wt % with respect to a total weight of R245fa and R600. Above this value, the refrigerant becomes incombustible. Therefore, the weight percentage may be set to this value or more.

R404A is constituted of R125 (pentafluoroethane: $CHF_2CF_3$), R143a (1,1,1-trifluoroethane: $CH_3CF_3$) and R134a (1,1,1,2-tetrafluoroethane: $CH_2FCF_3$), and a composition includes 44 wt % of R125, 52 wt % of R143a and 4 wt % of R134a. The mixed refrigerant has a boiling point of −46.48° C. Therefore, the refrigerant can be used as a substitute for heretofore used R22 having a boiling point of −40.8° C.

R508 is constituted of R23 (trifluoromethane: $CHF_3$) and R116 (hexafluoroethane: $CF_3CF_3$), and a composition includes 39 wt % of R23 and 61 wt % of R116. The mixed refrigerant has a boiling point of −88.64° C.

Moreover, R14 is tetrafluoromethane (carbon tetrafluoride: $CF_4$), R50 is methane ($CH_4$) and R740 is argon (Ar). As to the boiling points of these refrigerants, R14 has a boiling point of −127.9° C., R50 has −161.5° C. and R740 has −185.86° C. It is to be noted that R50 might cause explosion when coupled with oxygen, but when R50 is mixed with R14, the danger of the explosion is eliminated. Therefore, even if a mixed refrigerant leakage accident occurs, any explosion is not generated.

It is to be noted that as to the above refrigerants, R245fa and R600, and R14 and R50 are beforehand mixed once in an incombustible state. Afterward, the mixed refrigerant of R245fa and R600, R404A, R5080A, the mixed refrigerant of R14 and R50, and R740 are beforehand mixed, and introduced into the refrigerant circuit. Alternatively, R245fa and R600, R404A, R508A, R14 and R50, and R740 are introduced in this order from the refrigerant having the highest boiling point. The composition of the refrigerants includes, for example, 10.3 wt % of the mixed refrigerant of R245fa and R600, 28 wt % of R404A, 29.2 wt % of R508A, 26.4 wt % of the mixed refrigerant of R14 and R50 and 5.1 wt % of R740.

It is to be noted that in the present embodiment, 4 wt % of n-pentane (in a range of 0.5 to 2 wt % with respect to the total weight of the non-azeotropic refrigerants) may be added to R404A.

Next, the circulation of the refrigerant on a low temperature side will be described. The high-temperature high-pressure gas mixed refrigerant discharged from the compressor 20 flows into the radiator 39 via the discharge side pipe 20D, and radiates heat in the radiator. Then, a part of n-pentane or R600 as an oil carrier refrigerant having a high boiling point and a satisfactory oil solubility in the mixed refrigerant is condensed and liquefied.

The mixed refrigerant discharged from the radiator 39 flows into the oil separator 40, and a large part of lubricating oil of the compressor 20 mixed with the refrigerant and a part (a part of n-pentane or R600) of the refrigerant condensed and liquefied in the radiator 39 are fed back to the compressor 20 via the oil return tube 41. In consequence, the refrigerant having higher purity and lower boiling point flows into the refrigerant circuit 38 after the cascade heat exchanger 43, and the extremely low temperature can efficiently be obtained. Therefore, even the compressors 10 and 20 having the same capability can cool the inside of the storage chamber 4 as a cooling target having a larger volume to a predetermined extremely low temperature, and the storage capacity can be increased without enlarging the whole refrigeration apparatus 1.

Here, in the present embodiment, the refrigerant fed into the oil separator 40 is once cooled in the radiator 39, and hence the temperature of the refrigerant flowing into the cascade heat exchanger 43 can be lowered. Specifically, the temperature of the refrigerant fed into the cascade heat exchanger 43 has heretofore been about +65° C., but the temperature can be lowered to about +45° C. in the present embodiment.

Consequently, in the cascade heat exchanger 43, a load to be applied to the compressor of the high-temperature-side refrigerant circuit 25 for cooling the refrigerant in the low-temperature-side refrigerant circuit 35 can be decreased. Moreover, since the refrigerant in the low-temperature-side refrigerant circuit 35 can effectively be cooled, the load to be applied to the compressor 20 constituting the low-temperature-side refrigerant circuit 35 can be decreased. In consequence, the operation efficiency of the whole refrigeration apparatus 1 can be improved.

Another mixed refrigerant itself is cooled to about −40° C. to −30° C. by the evaporator 34 in the cascade heat exchanger 43 to condense and liquefy a part of the refrigerants (a part of R245fa, R600, R404A and R508) having the high boiling point in the mixed refrigerant. Then, the mixed refrigerant discharged from the condensing pipe 42 of the cascade heat exchanger 43 flows into the first gas-liquid separator 46 through the drier 44. At this time, since R14, R50 and R740 in the mixed refrigerant have a remarkably low boiling point, the refrigerants are not condensed yet, and have a gas state, and an only part of R245fa, R600, R404A and R508 is condensed and liquefied. Therefore, R14, R50 and R740 are separated to the gas-phase pipe 47, and R245fa, R600, R404A and R508 are separated to the liquid-phase pipe 50.

The refrigerant mixture which has flowed into the gas-phase pipe 47 performs heat exchange between the mixture and the first intermediate heat exchanger 48, is condensed, and then reaches the second gas-liquid separator 49. Here, the low-temperature refrigerant returning from the evaporation pipe 62 flows into the first intermediate heat exchanger 48. Furthermore, the liquid refrigerant which has flowed into the liquid-phase pipe 50 flows through the drier 51 to reach the capillary tube 52 where the pressure of the refrigerant is reduced. Afterward, the refrigerant flows into the first intermediate heat exchanger 48 to evaporate in the exchanger, thereby contributing to the cooling. Therefore, as a result of the cooling of a part of R14, R50 R740 and R508 which is not condensed, the first intermediate heat exchanger 48 has an intermediate temperature of about −60° C. Therefore, R508 in the mixed refrigerant which has passed through the gas-phase pipe 47 is completely condensed and liquefied, and branched to the second gas-liquid separator 49. R14, R50 and R740 have a lower boiling point, and hence still have a gas state.

In the second intermediate heat exchanger 56, the drier 54 removes the water content from R508 branched by the second gas-liquid separator 49, and the pressure of the refrigerant is reduced by the capillary tube 55. Afterward, the refrigerant flows into the second intermediate heat exchanger 56, R14, R50 and R740 in the gas-phase pipe 57 are cooled together with the low-temperature refrigerant returning from the evaporation pipe 62, and R14 having the highest evaporation temperature among these refrigerants is condensed. In consequence, the second intermediate heat exchanger 56 has an intermediate temperature of about −90° C.

The gas-phase pipe 57 passing through this second intermediate heat exchanger 56 subsequently passes through the third intermediate heat exchanger 58 and the fourth intermediate heat exchanger 59. Here, the refrigerant immediately discharged from the evaporation pipe 62 is fed back to the fourth intermediate heat exchanger 59. According to an experiment, the fourth intermediate heat exchanger 59 reaches a considerably low intermediate temperature of about −130° C.

Consequently, a part of R50 and R740 in the gas-phase pipe 57 is condensed in the fourth intermediate heat exchanger 59, the water content is removed from a part of liquefied R14, R50 and R740 by the drier 60, and the pressure of the refrigerant is reduced by the capillary tube 61. Afterward, the refrigerant flows into the evaporation pipe 62, and evaporates in the pipe to cool the surrounding area. According to the experiment, at this time, the evaporation pipe 62 has an extremely low temperature in a range of −160.3° C. to −157.3° C.

Thus, the refrigerants still having a gas phase state are successively condensed in the intermediate heat exchangers 48, 56, 58 and 59 by use of an evaporation temperature difference between the refrigerants in the low-temperature-side refrigerant circuit 38, and an extremely low temperature of −150° C. or less can be achieved in the evaporation pipe 42 as a final stage. Therefore, the evaporation pipe 62 is wound along the insulating material 9 side of the inner box 6 in a heat exchange manner, so that an in-chamber temperature of −152° C. or less can be realized in the storage chamber 4 of the refrigeration apparatus 1.

The refrigerant discharged from the evaporation pipe 62 successively flows into the fourth intermediate heat exchanger 59, the third intermediate heat exchanger 58, the second intermediate heat exchanger 56 and the first intermediate heat exchanger 48, and the refrigerant joins the refrigerants evaporated in the respective heat exchangers, and returns the compressor 20 via the suction side pipe 20S.

A large part of the oil mixed with the refrigerant and discharged from the compressor 20 is separated by the oil separator 40 and returned to the compressor 20. However, the mist-like oil discharged from the oil separator 40 together with the refrigerant is returned to the compressor 20 in a state in which the oil is dissolved in R600 having high oil solubility. In consequence, the lubricating defect of the compressor 20, or locking can be prevented. Moreover, R600 returns the compressor 20 while maintaining the liquid state, and is evaporated in this compressor 20, so that the discharge temperature of the compressor 20 can be lowered.

The compressor 20 constituting the low-temperature-side refrigerant circuit 38 having the above constitution is subjected to ON-OFF control by a controller (not shown) based on the in-chamber temperature of the storage chamber 4. In this case, when the operation of the compressor 20 is stopped by the controller, the mixed refrigerant in the low-temperature-side refrigerant circuit 38 is collected in the expansion tank 65 via the check valve 67 having the expansion tank 65 direction as the forward direction.

In consequence, as compared with a case where the refrigerant is collected in the expansion tank 65 via the capillary tube 66 during the stop of the compressor 20, the refrigerant in the refrigerant circuit 38 can remarkably quickly be collected in the expansion tank 65 via the check valve 67.

Consequently, the rise of the pressure in the refrigerant circuit 38 can be prevented. When the compressor 20 is started by the controller, the refrigerant is gradually returned from the expansion tank 65 to the refrigerant circuit 38 via the capillary tube 66, and the starting load of the compressor 20 can be decreased.

Therefore, when the refrigerant is quickly collected in the expansion tank 65 during the stop of the compressor 20, an equilibrium pressure in the refrigerant circuit 38 can quickly be achieved. During the restart of the compressor 20, the compressor 20 can smoothly be restarted without applying any load to the compressor 20. In consequence, time required for achieving the equilibrium pressure in the refrigerant circuit 38 during the start of the compressor can remarkably be shortened to improve the operation efficiency of the compressor 20. For example, time required for a pull-down operation can be shortened to improve convenience.

On the other hand, in the refrigerant circuit of the refrigeration apparatus 1, the evaporation pipe 62 of the low-temperature-side refrigerant circuit 38 has an extremely low temperature in a range of −160.3° C. to −157.3° C., and even the cascade heat exchanger 43 has a low temperature in a range of about −40° C. to −30° C. Furthermore, the first intermediate heat exchanger 48 has an extremely low temperature of about −60° C., the second intermediate heat exchanger 56 has about −90° C., and the third and fourth intermediate heat exchangers 58, 59 have about −130° C. Therefore, even the heat exchanger 43 and the like excluding the evaporation pipe 62 arranged in the insulating box body 2 need to be sufficiently insulated.

Figure 7:
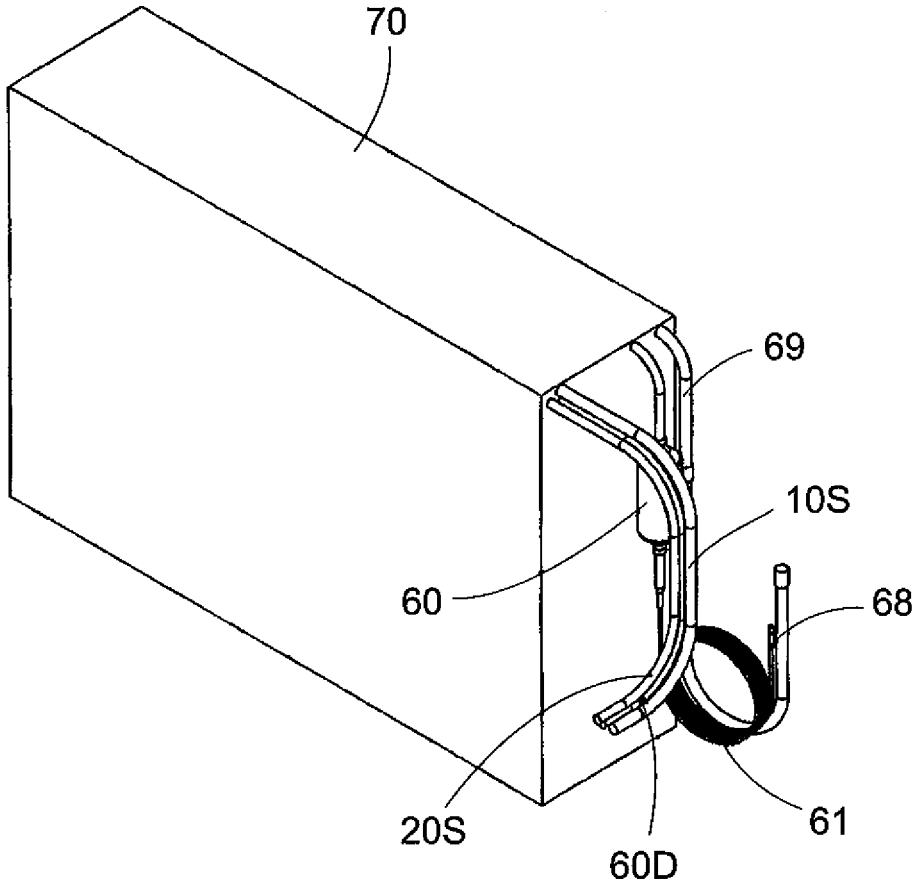
FIG. 7 is a perspective view of an insulating structure.

To solve the problem, the peripheries of the cascade heat exchanger 43 and the first, second, third and fourth intermediate heat exchangers are surrounded by an insulating material to form the rectangular insulating structure 70. FIG. 7 shows a perspective view of the insulating structure 70, and FIG. 8 shows a perspective view in a state in which an insulating material of the insulating structure 70 has been removed.

Here, a detailed structure of the insulating structure 70 will be described. It is to be noted that parts surrounded by dotted lines in FIG. 6, that is, in addition to the above heat exchangers, the accumulator 35 and the capillary tube 33 constituting the high-temperature-side refrigerant circuit 25, and the drier 44, the gas-liquid separators 46, 49, the driers 51, 54 and the capillary tubes 52, 55 constituting the low-temperature-side refrigerant circuit 38 constitute the insulating structure 70. The cascade heat exchanger 43 is arranged on one end of the insulating structure 70, and the intermediate heat exchangers 48, 56, 58 and 59 are positioned by the side of this cascade heat exchanger 43 and arranged in layers.

Each of the intermediate heat exchangers 48, 56, 58 and 59 has a spiral double pipe structure in which an outer pipe having a comparatively large diameter is spirally wound as much as a plurality of stages, the resultant flat pipes are superimposed on one another, and each of the gas-phase pipes 47, 57 passes as an inner pipe on the inner side from the outer pipe with a space being left between the pipes. In the present embodiment, the exchanges are arranged in order from the exchanger having the lowest temperature, that is, the fourth and third intermediate heat exchangers 58, 59 are arranged in the lowermost layer, the second intermediate heat exchanger 56 is arranged on the exchangers, and the first intermediate heat exchanger 48 is arranged in the uppermost layer.

Figure 8:
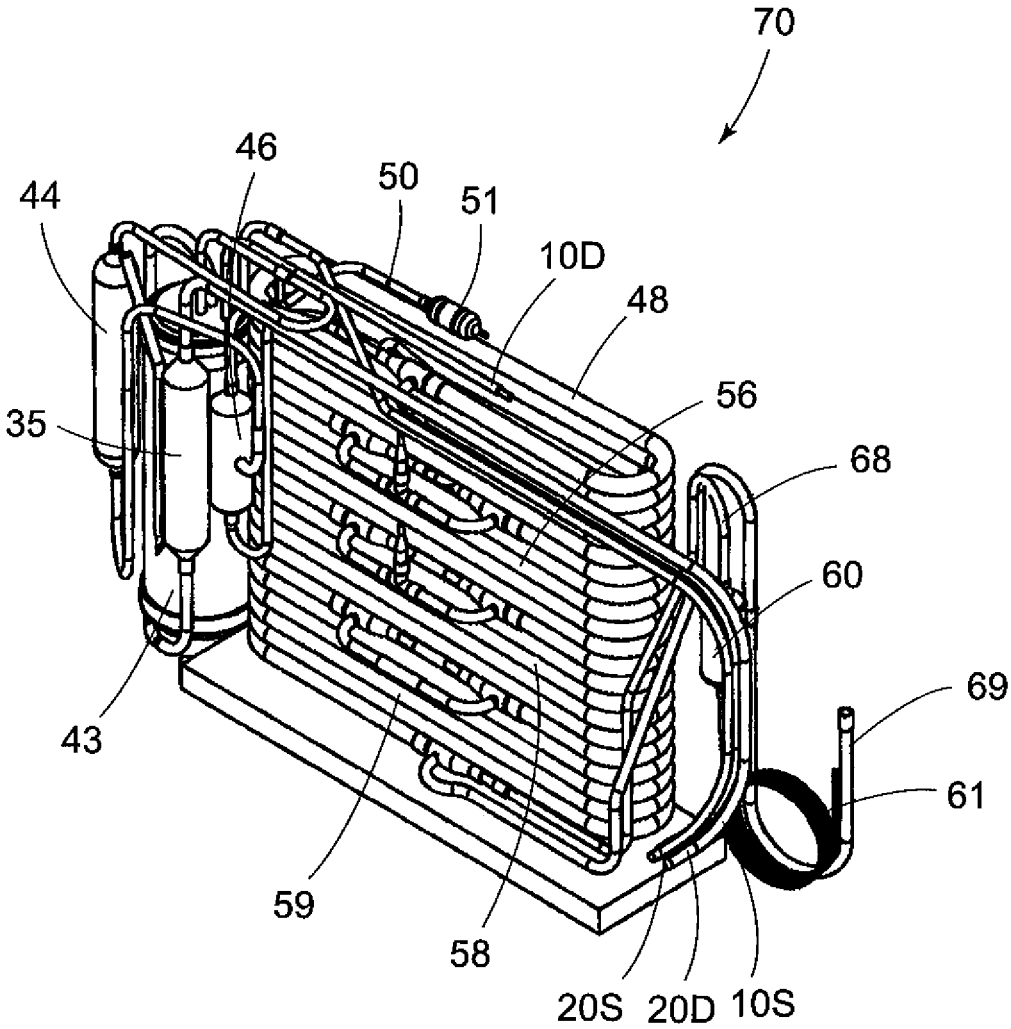
FIG. 8 is a perspective view in a state in which an insulating material of the insulating structure has been removed.

Moreover, on the inner sides from these intermediate heat exchangers and around the cascade heat exchanger 43, the gas-liquid separators 46, 49 (it is to be noted that the second gas-liquid separator 49 is not shown in FIG. 8), the driers 44, 51 and 54 (not shown in FIG. 8), the capillary tubes 33, 52 and 55 (not shown) and the accumulator 35 are arranged, a dead space is decreased, and dimensions are decreased.

Furthermore, in the insulating structure 70 according to the embodiment, pipes connecting devices arranged in the insulating structure 70 to those arranged outside the insulating structure 70 are arranged so as to face a one-end side surface on a side opposite to a side provided with the cascade heat exchanger 34. Specifically, pipe connecting portions of the discharge side pipe 10D after the condenser 31 of the high-temperature-side refrigerant circuit 25 connected to the cascade heat exchanger 34, the suction side pipe 10S connected to the compressor 10, the discharge side pipe 20D similarly after the oil separator 40 of the low-temperature-side refrigerant circuit 38 connected to the cascade heat exchanger 34, the suction side pipe 20S connected to the suction side of the compressor 20, the pipe 68 connected to the evaporation pipe 62 from the gas-phase pipe 57 arranged in the fourth intermediate heat exchanger 59 and the return pipe 69 connected to the fourth intermediate heat exchanger 59 from the evaporation pipe 62 are arranged on the one side surface of the insulating structure 70 in a concentrated manner.

At this time, the suction side pipes 10S, 20S and the discharge side pipe 20D through which the refrigerant having a comparatively high temperature circulates are bundled and externally arranged toward the mechanical chamber 3 in a state in which the insulating structure 70 is attached to the insulating box body 2 in the present embodiment. Moreover, the pipe 68 and the return pipe 69 which are connected to the evaporation pipe 62 and through which the extremely low temperature refrigerant circulates are converged and externally arranged toward the insulating box body 2 on a side opposite to the suction side pipe 10S and the like in the state in which the insulating structure 70 is attached to the insulating box body 2 in the present embodiment. It is to be noted that the drier 60 and the capillary tube 61 connected to the pipe 68 are arranged outside the insulating structure 70.

Figure 9:
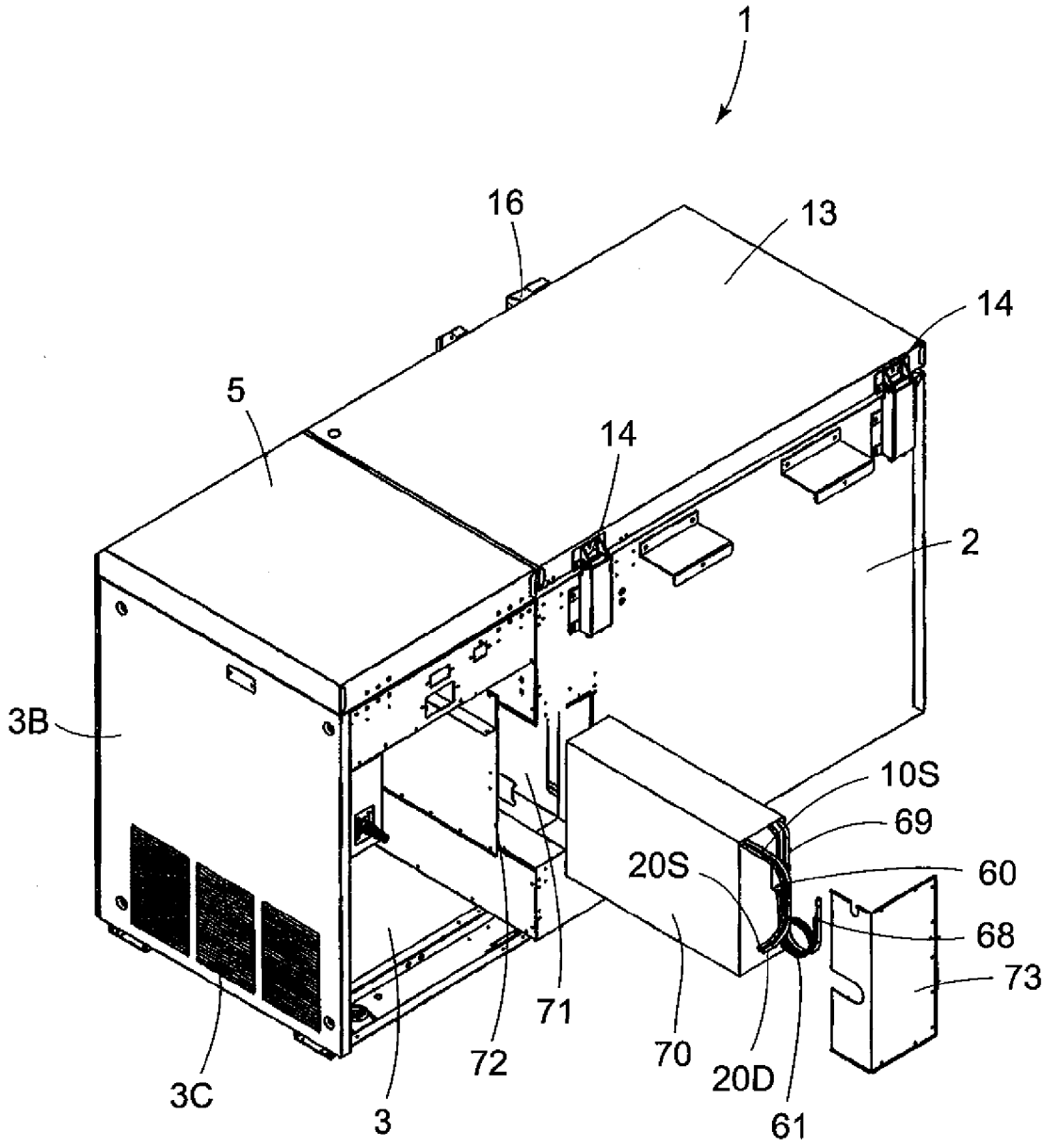
FIG. 9 is a rear perspective view of the refrigeration apparatus showing a state in which the insulating structure is attached.
Figure 10:
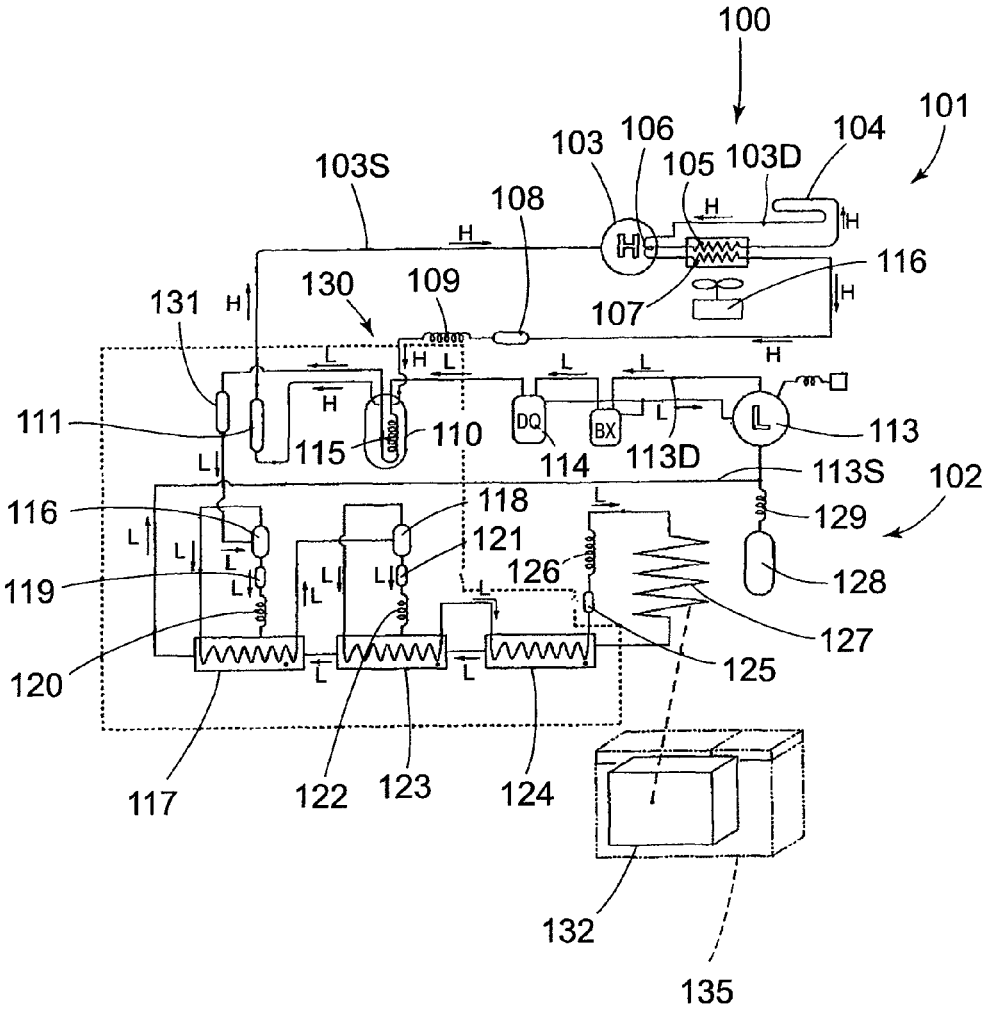
PRIOR ART FIG. 10
FIG. 10 is a refrigerant circuit diagram of a conventional refrigeration apparatus.
Figure 11:
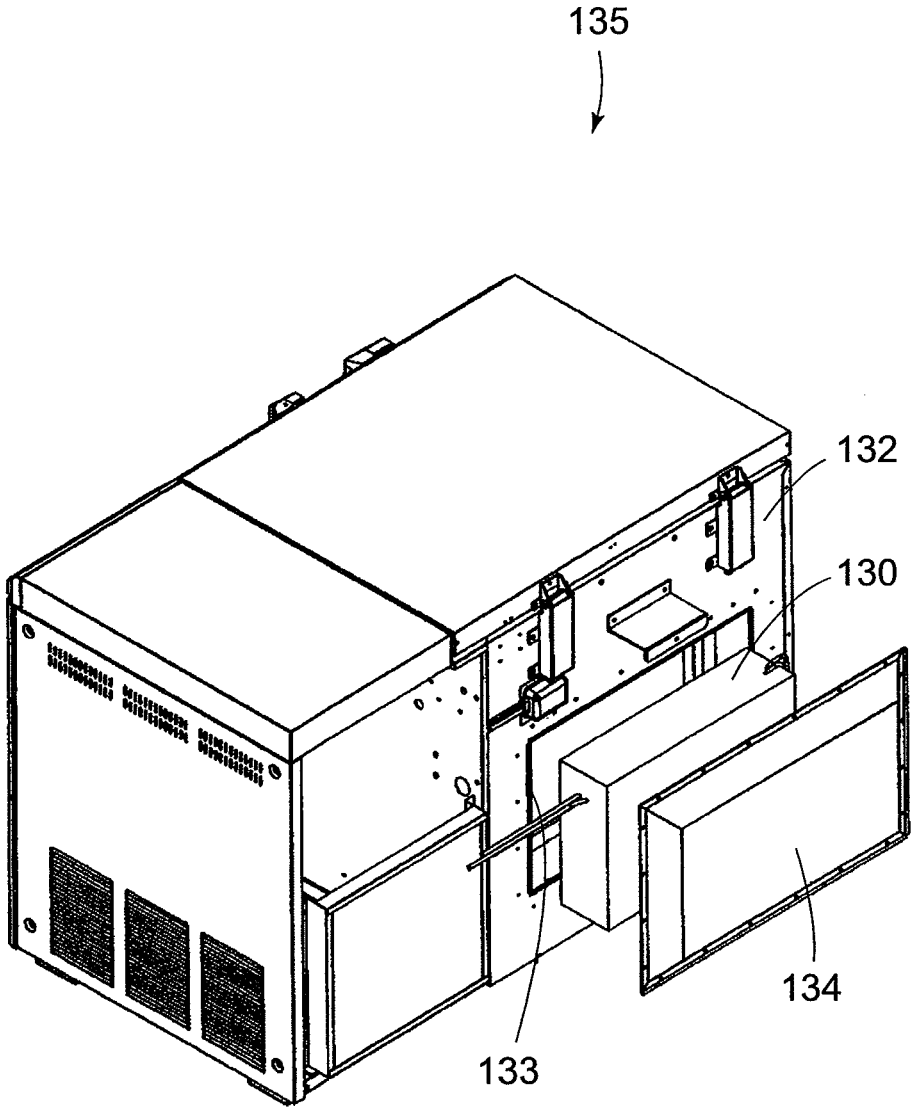
PRIOR ART FIG. 11
FIG. 11 is a rear perspective view of the conventional refrigeration apparatus.

On the other hand, FIG. 9 shows a back perspective view of the refrigeration apparatus 1. In the refrigeration apparatus 1, the side wall of the insulating box body 2 positioned on the mechanical chamber 3 side is provided with a rectangular opening 71 extending in a front-to-rear direction and opening rearwards, and the rear part of the side wall on the mechanical chamber 3 side is provided with a cutout 72 corresponding to the opening 71. The insulating structure 70 is inserted into this opening 71 from the backside of the insulating box body 2. At this time, the insulating structure 70 is inserted into the opening 71 from the side provided with the cascade heat exchanger 34. In consequence, the pipes 10S, 20S, 20D, 68 and 69 arranged so as to extend on one side of the insulating structure 70, and the pipe 10D connected to the capillary tube 33 of the high-temperature-side refrigerant circuit 25 are opposed to the surface in a direction in which the insulating structure 70 is inserted or removed, that is, the back surface of the insulating box body 2 in the present embodiment.

Therefore, after installing devices such as the compressors 10, 20 in the mechanical chamber 3, the insulating structure 70 is finally inserted into the opening 71. In this state, the pipes 68, 69 are connected to the evaporation pipe 62 provided on the insulating box body 2 side, and the pipes 10S, 10D, 20S and 20D are connected to the pipes of the devices on the mechanical chamber 3 side. In consequence, the devices constituting the insulating structure 70 can easily be connected to the evaporation pipe 62 arranged in the insulating box body 2 and the pipes of devices such as the compressors 10, 20 arranged in the mechanical chamber 3 from the back surface of the insulating box body 2, and piping operation efficiency and assembling operation efficiency can be improved. Moreover, even if the devices constituting the insulating structure 70 cause failure or the like, the insulating structure 70 is drawn in a direction different from a direction in which the insulating box body 2 and the mechanical chamber 3 are constituted, and a maintenance operation can easily be performed.

Moreover, a part of the back surface from which the pipes of the insulating structure 70 extend and the side surface opposed to the mechanical chamber 3 side is closed by a cover member 73 bent so as to form a substantially L-shaped section. It is to be noted that in this case, an insulating plate (not shown) filled with glass wool may be arranged in a gap formed between the insulating structure 70 and the side surface on the mechanical chamber 3 side.

According to the above constitution, the cascade heat exchanger 43 and the intermediate heat exchangers 48, 56, 58 and 59 are arranged on the side wall of the insulating box body 2 on the mechanical chamber 3 side in a state in which the insulating structure 70 is integrally formed of the insulating material. Therefore, as compared with a case where the insulating structure 70 is installed in the back surface portion of the insulating box body 2 as in the conventional example, the depth dimension of the whole refrigeration apparatus 1 can be decreased.

Therefore, it is possible to avoid a disadvantage that the depth dimension of the whole apparatus 1 increases owing to the presence of a protruding part constituted of the insulating structure 70 for surrounding the cascade heat exchanger 43 and the like. Even in the refrigeration apparatus having an in-chamber temperature of −150° C. or less as in the present embodiment, while securing an in-chamber depth dimension of about 495 mm, the whole depth dimension can be suppressed to about 765 mm. In consequence, a disadvantage that the refrigeration apparatus is stuck in a usual carrying entrance (in general, about 800 mm) can be avoided. In particular, the insulating structure 70 can be carried inwards and outwards through the usual carrying entrance in a state in which the structure is attached to the apparatus 1. Therefore, in the installation place, the insulating structure 70 does not have to be disconnected from or connected to the main body, and a laborious operation can be avoided.

In consequence, without especially decreasing the in-chamber storage volume, the refrigeration apparatus 1 can easily be carried inwards or outwards. Moreover, even in the installation place, the insulating structure 70 for surrounding the cascade heat exchanger 43 and the like does not protrude externally from the back surface, and hence the area required for installation can be decreased.

Moreover, as in the conventional example, the back surface of the insulating box body 2 is not provided with the cascade heat exchanger or the insulating structure for surrounding the periphery of each intermediate heat exchanger. Therefore, as described above, the vacuum insulating panels 12 can be arranged in the front wall 6A and the rear wall 6B of the insulating box body 2 configured to face the outside and the side wall 6C opposite to the mechanical chamber side. Even at an extremely low temperature of, for example, −150° C. or less in the storage chamber 4, the insulating performance of the insulating box body 2 itself can be improved. Therefore, even when the dimension can be decreased and the outer dimension is similar to that in the conventional example, the storage volume in the storage chamber 4 can be increased. Alternatively, even with the storage volume similar to that in the conventional example, the outer dimension can be decreased. Even in this case, the area required for installing the refrigeration apparatus 1 can be decreased.

It is to be noted that in the present embodiment, the insulating structure 70 can be inserted into or detached from the side wall of the insulating box body 2 from the backside, that is, the back surface of the refrigeration apparatus 1, but this is not restrictive, and the insulating structure may be inserted or detached from the front of the insulating box body 2 or the upside of the insulating box body. In consequence, in the same manner as in the present embodiment, the cascade heat exchanger 43, the intermediate heat exchanger 48 and the like integrated as the insulating structure 70 can easily be incorporated in the apparatus 1 main body, and the assembling operation efficiency can be improved.

Moreover, in the same manner as in the present embodiment, the insulating structure 70 can be drawn to the front or the upside to remove the structure from the apparatus 1 main body, and the maintenance operation of the cascade heat exchanger 43, the intermediate heat exchanger 48 and the like constituting the insulating structure 70 can easily be performed.

It is to be noted that in the present embodiment, in the insulating structure 70, the cascade heat exchanger 43, the intermediate heat exchanger 48 and the like constituting the refrigeration apparatus 1 are integrally constituted. However, in addition, the only cascade heat exchanger 43, or the only intermediate heat exchanger 48 and the like may integrally be constituted as the insulating structure 70, and may detachably be arranged on the side wall of the insulating box body 2 as in the present embodiment.

Moreover, in the present embodiment, the refrigeration apparatus 1 of a two-dimensional multistage system has been described. The refrigerant circuit constituting the refrigeration apparatus 1 is constituted of the high-temperature-side refrigerant circuit 25 and the low-temperature-side refrigerant circuit 38 constituting independent refrigerant closed circuits so that the refrigerant discharged from the compressor 10 or 20 is condensed and then evaporated to exert a cooling function. The low-temperature-side refrigerant circuit 38 has the compressor 20, the condensing pipe 42, the evaporation pipe 62, a plurality of, specifically four intermediate heat exchangers 48, 56, 58 and 59 connected in series so that the refrigerant fed back from the evaporation pipe 62 circulates, and a plurality of, specifically three capillary tubes 42, 55 and 61. In the circuit, a plurality of types of non-azeotropic mixed refrigerants are introduced, and the condensed refrigerant in the refrigerants fed through the condensing pipe 42 joins each intermediate heat exchanger via each capillary tube. The non-condensed refrigerant in the refrigerants is cooled by the intermediate heat exchanger to successively condense the refrigerant having a lower boiling point. The refrigerant having the lowest boiling point is allowed to flow into the evaporation pipe 62 through the final-stage capillary tube 61. Moreover, the evaporator 34 of the high-temperature-side refrigerant circuit 25 and the condensing pipe 42 of the low-temperature-side refrigerant circuit 38 constitute the cascade heat exchanger 43, and the extremely low temperature is obtained in the evaporation pipe 42 of the low-temperature-side refrigerant circuit 38. However, the present invention is not limited to this apparatus.

That is, even in, for example, a refrigeration apparatus of a simple multi-dimensional (two-dimensional) system which includes a high-temperature-side refrigerant circuit and a low-temperature-side refrigerant circuit constituting independent refrigerant closed circuits where refrigerants discharged from compressors are condensed and then evaporated to exert a cooling function and in which an evaporator of the high-temperature-side refrigerant circuit and a condenser of the low-temperature-side refrigerant circuit constitute a cascade heat exchanger and in which an extremely low temperature is obtained in an evaporator of the low-temperature-side refrigerant circuit, the cascade heat exchanger 43 may be constituted in the insulating structure 70 as in the present embodiment, and the insulating structure 70 may detachably be inserted into the side surface of the insulating box body 2 on the mechanical chamber 3 side, so that a similar effect can be obtained.

Moreover, similarly, even in a refrigeration apparatus of a simple multistage system which includes a compressor, a condenser, an evaporator, a plurality of intermediate heat exchangers connected in series so that a refrigerant fed back from the evaporator circulates and a plurality of pressure reducing units and in which a plurality of types of non-azeotropic mixed refrigerants are introduced and in which a condensed refrigerant in the refrigerants fed through the condenser is allowed to join the intermediate heat exchanger via the pressure reducing unit and in which a non-condensed refrigerant in the refrigerants is cooled by the intermediate heat exchanger to successively condense the refrigerant having a lower boiling point and in which the refrigerant having the lowest boiling point is allowed to flow into the evaporator via the final-stage pressure reducing unit to obtain an extremely low temperature, the respective intermediate heat exchangers may be constituted in the insulating structure 70 as in the present embodiment, and the insulating structure 70 may detachably be inserted into the side surface of the insulating box body 2 on the mechanical chamber 3 side, so that the similar effect can be obtained.

What is claimed is:

1. A refrigeration apparatus comprising: a refrigerant circuit including a compressor, an evaporator, a heat exchanger, a first pipe connected between the compressor and the heat exchanger, and a second pipe connected between the evaporator and the heat exchanger;

a mechanical chamber including the compressor;

an insulating box including a storage chamber surrounded by the evaporator and an accommodating room arranged between the mechanical chamber and the storage chamber; and an insulating structure including an insulating material surrounding the heat exchanger;

wherein the insulating structure is detachably accommodated in the accommodating room, the insulating structure including at least a first planar surface and a second planar surface opposite to the first planar surface, the insulating structure being inserted into an opening of the accommodating room from a side of the first planar surface, wherein the first pipe and the second pipe extend from the second side of the insulating structure, wherein the insulating structure has at least one major planar surface and at least two minor planar surfaces, the at least two minor planar surfaces including the first and second planar surfaces, wherein the at least one major planar surface is parallel to a wall between the storage chamber and the mechanical chamber, wherein the at least two minor planar surfaces are not parallel to the wall between the storage chamber and the mechanical chamber.

2. The refrigeration apparatus of claim 1, wherein the opening opens rearwards, frontwards or upwards, and the insulating structure is detachably inserted into the opening from a backside, a front side or an upside of the insulating box body.

3. The refrigeration apparatus of claim 1, wherein the first and second pipes extend from the insulating structure in a direction parallel to the direction in which the insulating structure is inserted into the opening.

4. The refrigeration apparatus of claim 1, wherein the at least one major planar surface is abutting a wall of the mechanical chamber.

5. The refrigeration apparatus of claim 4, wherein the at least two minor planar surfaces are not abutting the wall of the mechanical chamber.

6. The refrigeration apparatus of claim 1, wherein the insulating box body includes a composite constitution of vacuum insulating panels and a foam insulating material, wherein the vacuum insulating panels are arranged in front and rear walls of the insulating box body and a side wall of the insulating box body on a side opposite to the mechanical chamber.

* * * * *